US008608351B2

(12) United States Patent
Peifer

(10) Patent No.: US 8,608,351 B2
(45) Date of Patent: Dec. 17, 2013

(54) REMOVABLE OPTICAL COMPONENT FOR LUMINAIRE

(75) Inventor: Donald A. Peifer, Mountain View, CA (US)

(73) Assignee: Lunera Lighting, Inc., Redwood City, CA (US)

( * ) Notice: Subject to any disclaimer, the term of this patent is extended or adjusted under 35 U.S.C. 154(b) by 263 days.

(21) Appl. No.: 13/043,965

(22) Filed: Mar. 9, 2011

(65) Prior Publication Data

US 2012/0230019 A1 Sep. 13, 2012

(51) Int. Cl.
*F21V 15/00* (2006.01)

(52) U.S. Cl.
USPC ..... 362/364; 362/147; 362/257; 362/311.01; 362/362; 362/150

(58) Field of Classification Search
USPC ..... 362/147, 257, 260, 311.01, 362, 364, 362/150, 223
See application file for complete search history.

(56) References Cited

U.S. PATENT DOCUMENTS

2003/0142499 A1* 7/2003 Chiu ..... 362/368
2005/0248950 A1* 11/2005 McCarthy, III ..... 362/375

* cited by examiner

*Primary Examiner* — Stephen F Husar
*Assistant Examiner* — Meghan Dunwiddie
(74) *Attorney, Agent, or Firm* — North Weber & Baugh LLP

(57) ABSTRACT

This is directed to a luminaire having a removable inner accessory and optical component. A luminaire can include a base and an outer accessory through which light generated by a light source placed in the base is transmitted. To customize the light emitted by the luminaire, an inner accessory having an optical component can be placed within the outer accessory. The optical component can be tuned to provide a light pattern corresponding to an environment in which the luminaire is placed. Because all of the components used to create the luminaire, other than the optical component, are standard, the luminaire can be easily constructed with a default optical component, but also easily customized at a minimal cost. In addition, the optical component can be recessed relative to the outer accessory to improve optical performance of the luminaire.

19 Claims, 7 Drawing Sheets

REMOVABLE OPTICAL COMPONENT FOR LUMINAIRE

BACKGROUND

Light fixtures provide a source of light to illuminate dark environments. A light fixture, or luminaire, can be constructed from a light source placed in contact with a cover directing light from the light source into an environment. In some cases, the cover of a luminaire can include particular optical properties for directing the light emitted by the luminaire. For example, the cover can include a diffuser for changing the radiation pattern of light provided by the light source within the luminaire. Some luminaires, however, can be placed in environments where a standard light pattern may be inefficient or lead to undesirable lighting artifacts. Alternatively, the cover can be substantially co-planar with a drop ceiling, and be a source of glare.

SUMMARY

A luminaire having a removable optical component, and systems for constructing the same, are provided.

A luminaire can include a base and a light source providing light to be emitted by the luminaire. A cover can be placed over the base, for example to provide a cosmetic surface for the luminaire. While in some cases the cover can also include optical properties for modifying the light transmitted by the cover, customizing the optical features for different purposes may be a time consuming and expensive proposal.

Instead of providing a cover with optical properties, the luminaire can include an optical component placed over the light source. The optical component can be recessed relative to a bottom surface of the luminaire, which can correspond to a surface of a wall or ceiling to which the luminaire is attached. For example, the optical component can be recessed relative to panels of a drop grid ceiling. This may reduce glare or other adverse optical artifacts.

To reduce costs, the optical component can be removably retained within the luminaire. In some cases, the optical component can be coupled to an inner accessory that in turn, can be releasably coupled to the luminaire. For example, the inner accessory can include a recessed platform for retaining the optical component, and a base structure operative to engage a base of the luminaire. In this manner, a default or standard luminaire can be constructed in large quantities at a reduced cost, but can easily be customized for specific purposes by incorporating an inner accessory and optical component within the luminaire.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

This is directed to a luminaire, and systems for constructing the same, having a removable optical component. The optical component can be recessed relative to a bottom or exposed surface of the luminaire to improve performance of the luminaire.

Figure 1:
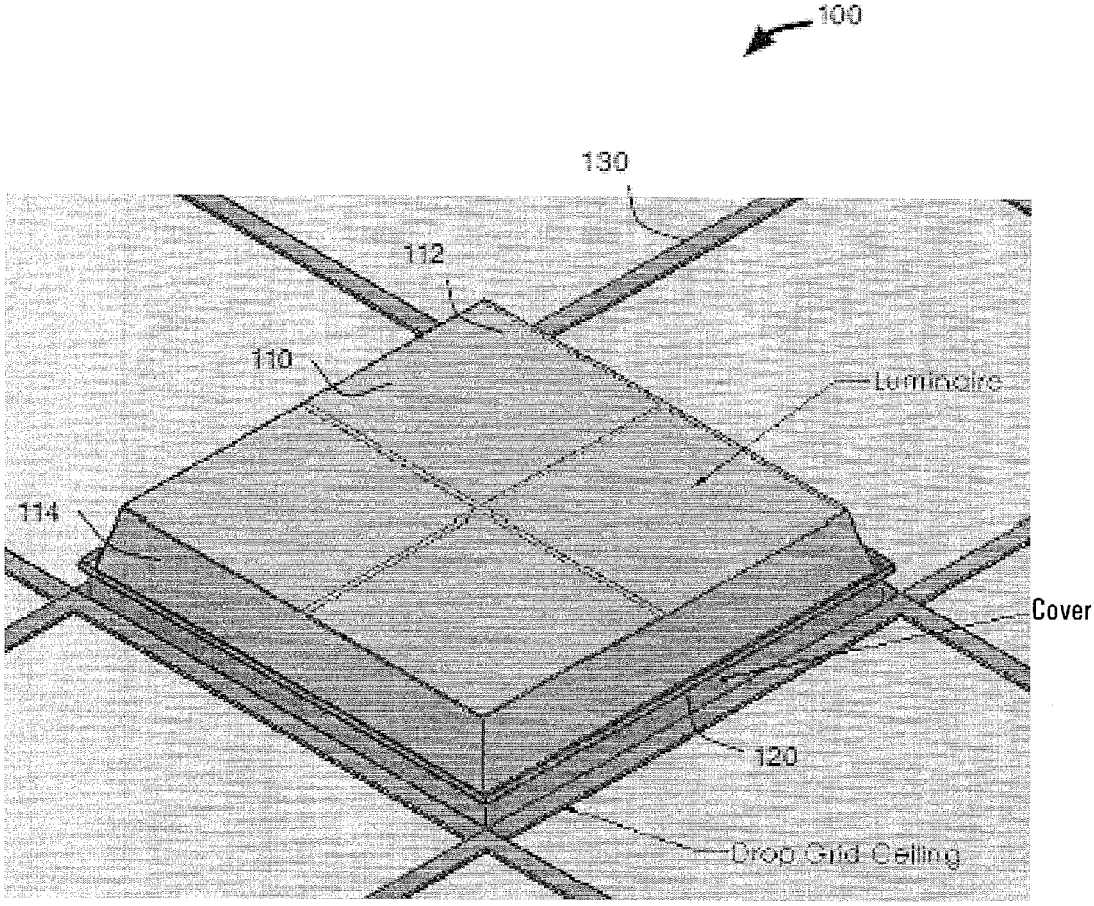
FIG. 1 is a schematic view of a luminaire.

A luminaire can be used to illuminate an environment. The luminaire can include a base providing a structure for the luminaire, a light source retained within the base, and a cosmetic component to hide the light source from view. FIG. 1 is a schematic view of a luminaire. Luminaire 100 can include base 110 providing a structure for the device. Base 110 can include plate 112 from which sidewalls 114 can extend. Plate 112 can, in some cases, provide a rear or back surface for base 110. Sidewalls 114 can extend from any suitable portion of plate 112. In some cases, sidewalls 114 can extend from a periphery of plate 112 such that a volume is enclosed by base 110. In some cases, base 110 can instead not include plate 112, but only sidewalls 114 forming a closed loop.

Base 110 can have any suitable shape or dimensions. For example, plate 112 of base 110 can include a square, rectangular, polygonal, circular, elliptical, or arbitrary shape. The size or dimensions of base 110 can be selected based on any suitable criteria. For example, the dimensions of base 110 can be selected based on a room or environment in which base 110 is to be placed, or based on default or standard dimensions for the luminaire.

Luminaire 100 can include a light source for providing light to an environment in which the luminaire is placed. The light source, not shown in FIG. 1, can be secured within base 110. Any suitable light source can be used in luminaire 100. For example, the light source can include an incandescent lighting source, a fluorescent lighting source, a solid state lighting source, a LED lighting source, or any other component operative to emit light. Luminaire 100 can include any suitable number or distribution of light sources. In some cases, the particular number of light sources may be selected based on the size of luminaire 100, the environment to be illuminated, desired radiation patterns provided by the luminaire, or combinations of these.

Some light sources may emit light in a radiation pattern that is not optimal to illuminate an environment. For example, a LED lighting source may emit light in a few specific orientations, rather than in a diffuse manner. To broaden the emission pattern of light provided by luminaire 100, luminaire 100 can include cover 120 placed over base 110 and the light source. Some portions of cover 120 can include optical properties or optical components such as, for example, a diffuser or a waveguide. Cover 120 can have any suitable shape including, for example, a planar shape or a shape having sidewalls. In particular, a portion of cover 120 that includes optical properties can extend over plate 112. In some cases, a bottom-most surface of cover 120 can be substantially co-planar with grid 130 in which luminaire 100 is placed.

Base 110 can be constructed from any suitable material. For example, base 110 can be constructed from plastic, a metal, a composite material, an organic material, or combinations of these. In some cases, it may be desirable for the material used for base 110 to be opaque so that components stored within luminaire 100 (e.g., the light source, a power supply, and fasteners) are not visible. Cover 120, on the other hand, can be constructed from an optically transparent or translucent material. Such materials can include, for example, an acrylic, polycarbonate, glass, or another plastic material that is substantially transparent can be used. In some cases, one or more portions of base 110 can be transparent or translucent, while other portions of the base (e.g., sidewalls) can be opaque.

The rooms or environments in which a luminaire can be placed are, in many cases, quite varied, and can have different requirements with respect to the desired light or radiation patterns required to illuminate the room. As a result, individual luminaires placed in an environment may each require a cover with customized optical properties (e.g., a customized diffuser) corresponding to the specific position of the luminaire within the room, the dimensions and shape of the room, and the desired illumination for the room to provide an ideal or best illumination. Alternatively, one or more standard covers with a pre-defined range of optical properties may be used for the luminaires, though this may result in a less than ideal illumination for the room. In addition, the position of the cover relative to the grid can cause the luminaire to become a source of glare.

Furthermore, defining individual covers having customized optical properties can be a time consuming and expensive process. A lighting designer may need to analyze each room, the position of each fixture, and the interaction of light emitted by each fixture to determine optical properties appropriate for each luminaire. A cover having the determined optical properties can then be constructed. This may also create an administrative burden, as it may become necessary to track each individual cover to ensure that it is placed over a correct base.

Figure 2:
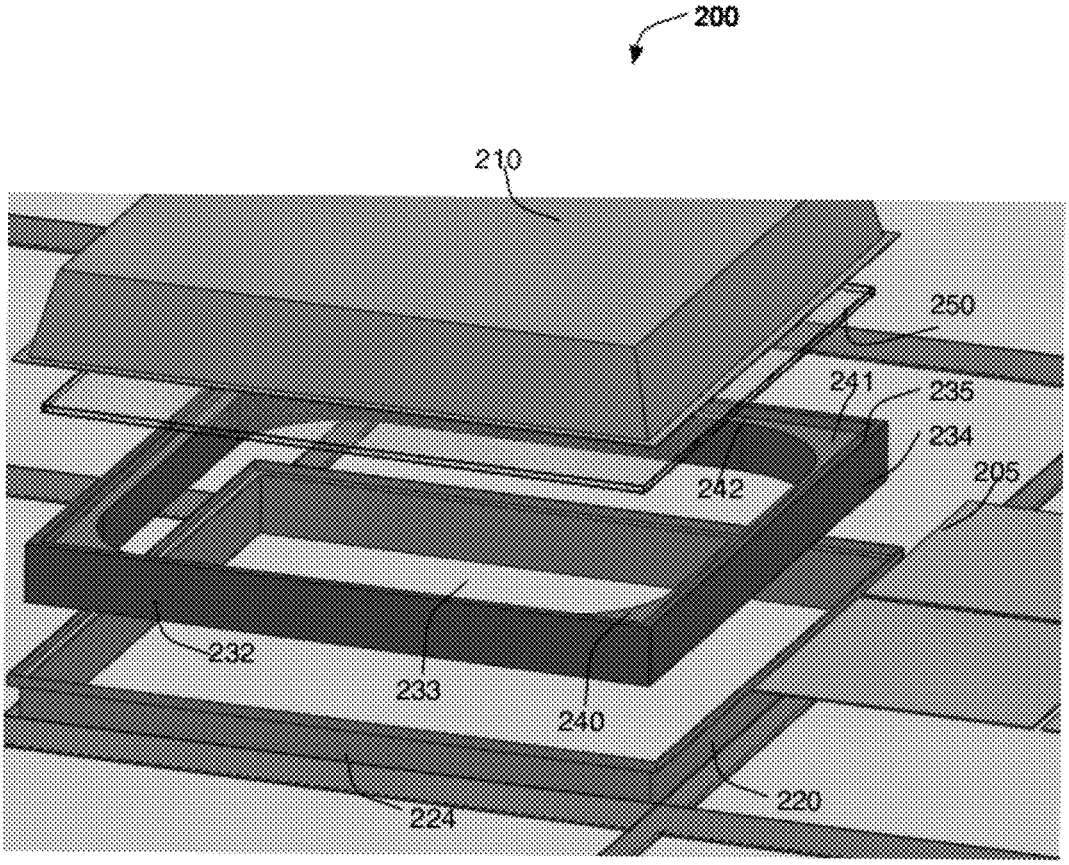
FIG. 2 is an exploded view of an illustrative luminaire having an optical component in accordance with some embodiments of the invention.
Figure 3:
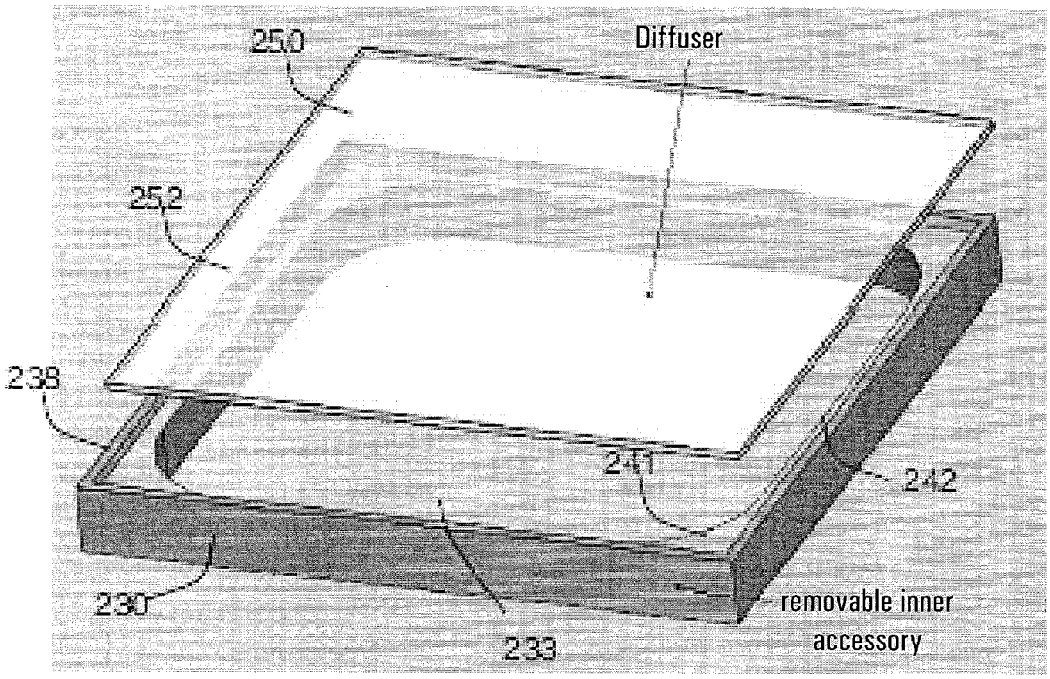
FIG. 3 is an exploded view of an inner accessory and an optical component in accordance with some embodiments of the invention
Figure 4:
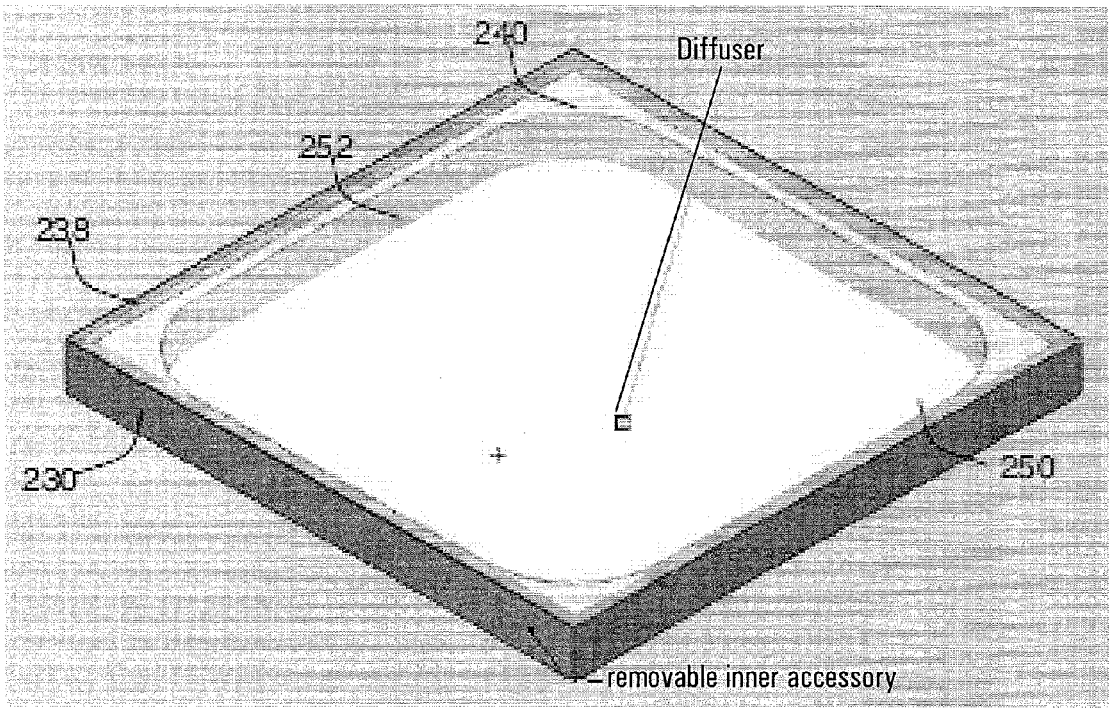
FIG. 4 is a perspective view of an assembled inner accessory and optical component in accordance with some embodiments of the invention.
Figure 5:
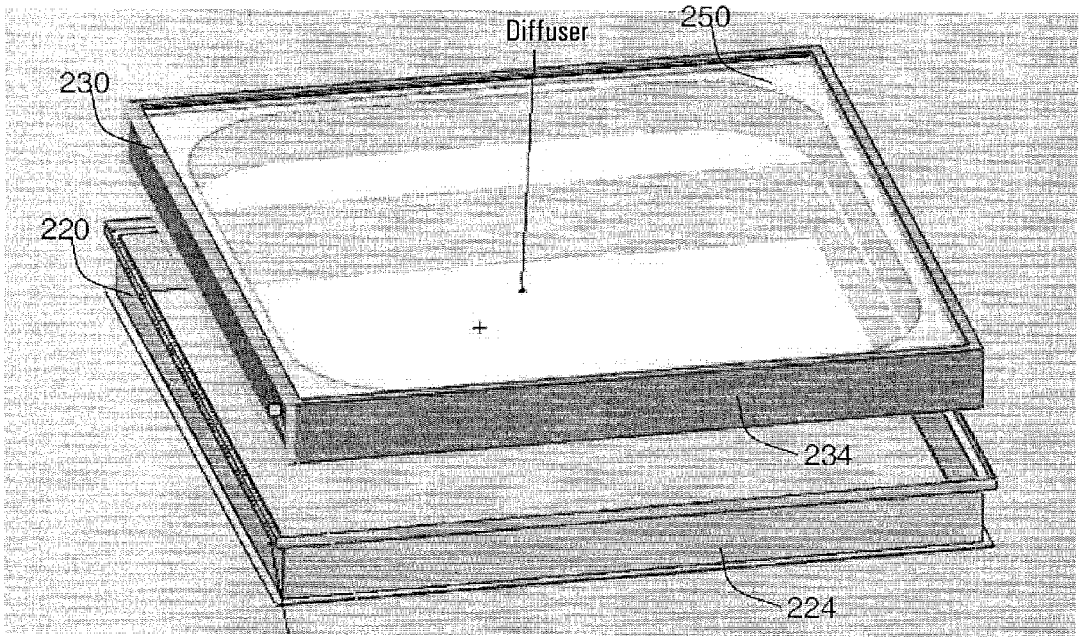
FIG. 5 is an exploded view of an assembled inner accessory and optical component with an outer accessory in accordance with some embodiments of the invention.
Figure 6:
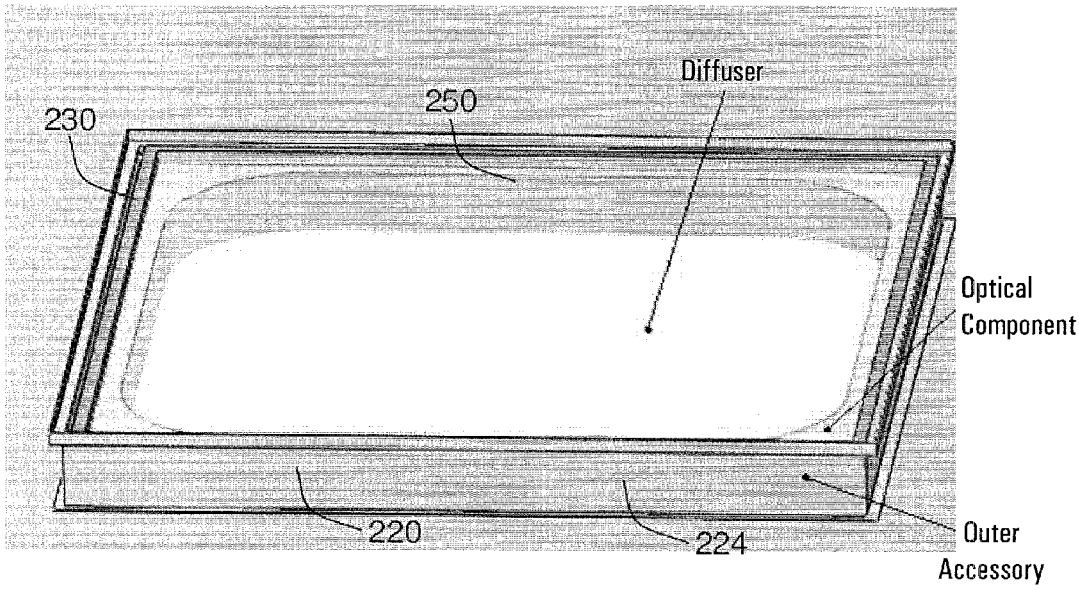
FIG. 6 is a perspective view of an outer accessory, inner accessory and optical component in accordance with some embodiments of the invention.
Figure 7:
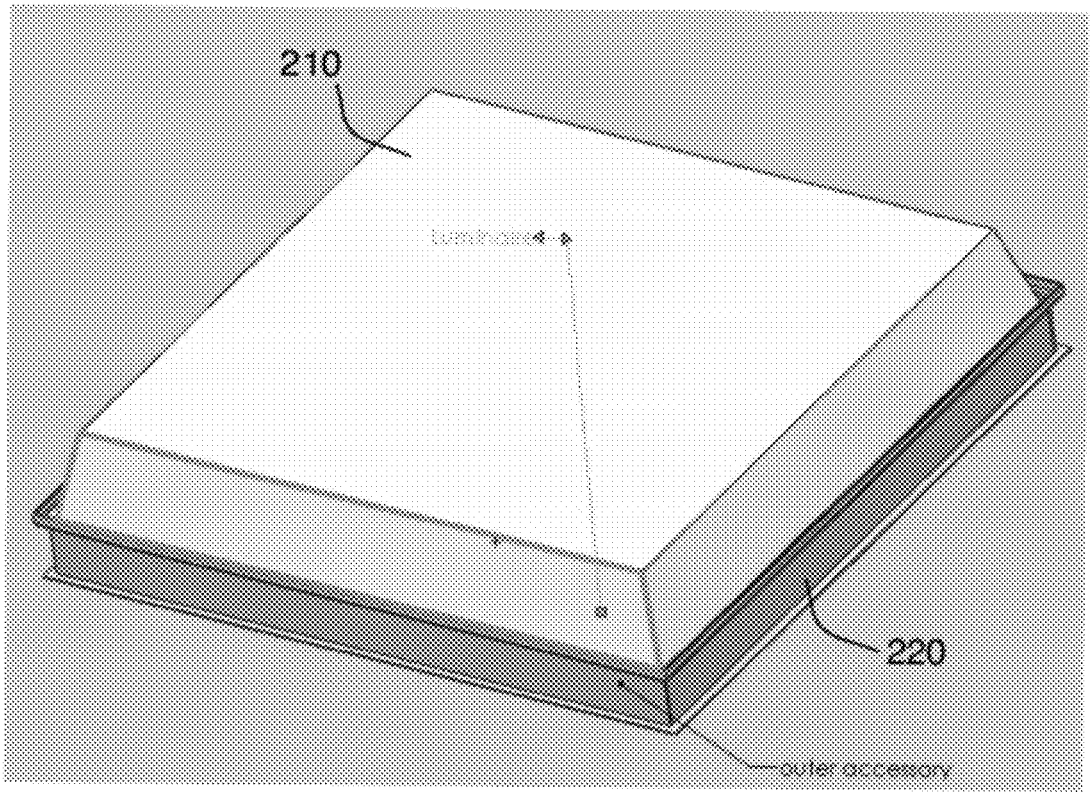
FIG. 7 is a perspective view of an outer accessory assembled to a base in accordance with some embodiments of the invention.
Figure 8:
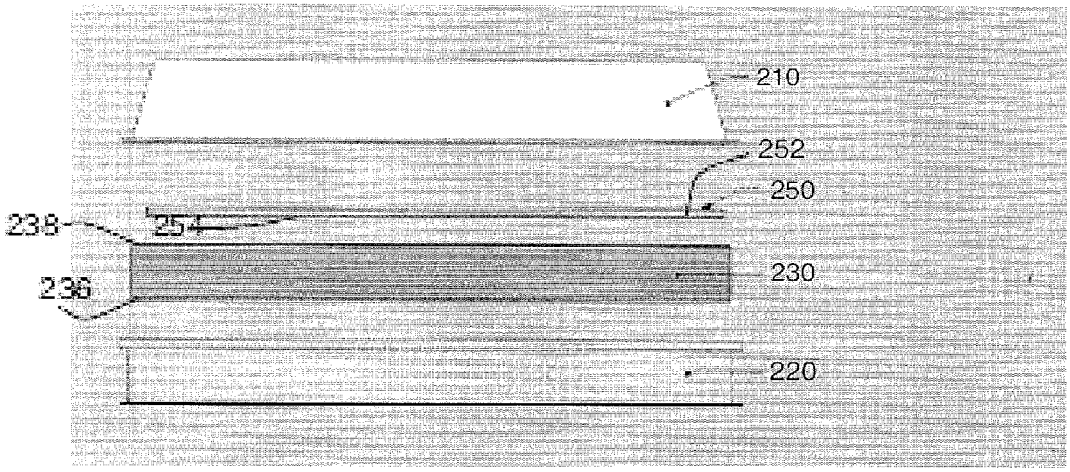
FIG. 8 is an exploded side view of a luminaire in accordance with some embodiments of the invention.
Figure 9:
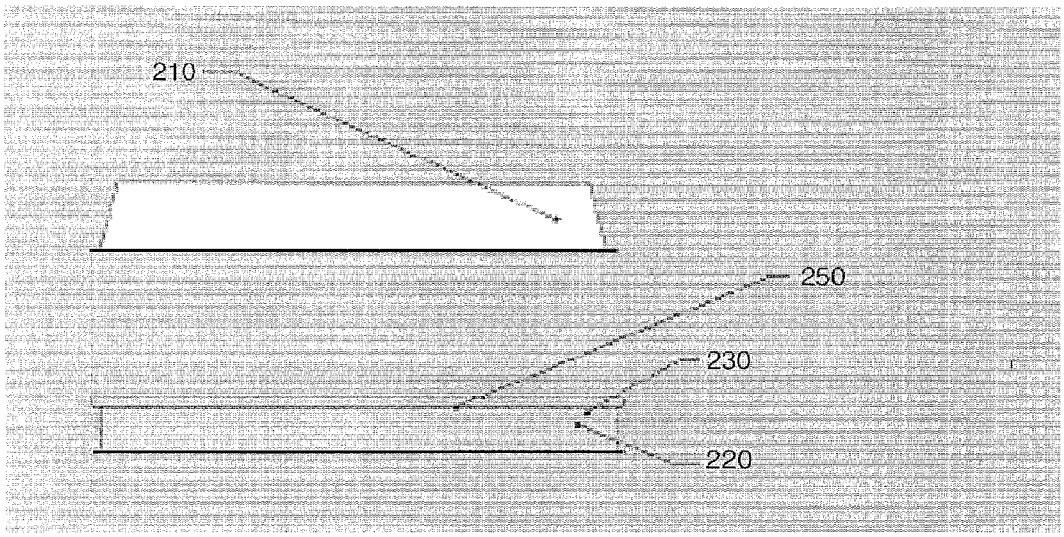
FIG. 9 is a partially exploded side view of a luminaire in accordance with some embodiments of the invention.

To reduce the burden while providing customized luminaires, it may be desirable to separate the optical properties of the luminaire from the cover. FIG. 2 is an exploded view of an illustrative luminaire having an optical component in accordance with some embodiments of the invention. FIG. 3 is an exploded view of an inner accessory and an optical component in accordance with some embodiments of the invention. FIG. 4 is a perspective view of an assembled inner accessory and optical component in accordance with some embodiments of the invention. FIG. 5 is an exploded view of an assembled inner accessory and optical component with an outer accessory in accordance with some embodiments of the invention. FIG. 6 is a perspective view of an outer accessory, inner accessory and optical component in accordance with some embodiments of the invention. FIG. 7 is a perspective view of an outer accessory assembled to a base in accordance with some embodiments of the invention. FIG. 8 is an exploded side view of a luminaire in accordance with some embodiments of the invention. FIG. 9 is a partially exploded side view of a luminaire in accordance with some embodiments of the invention.

Luminaire 200 can include base 210 having some or all of the properties of the luminaire described above in connection with FIG. 1. In addition, luminaire 200 can include inner accessory 230 operative to receive optical component 250, and to be placed within outer accessory 220 that is coupled to base 210. Inner accessory 230 can include base structure 232 that provides a support for optical component 250 and a mechanism for securing inner accessory 230 within luminaire 200. Because base structure 232 is placed within outer accessory 220, base structure 232 substantially defines a loop having a center opening 233 through which light from light source 205 placed in base 210 can pass. To maximize the region through which light may pass, it may be desirable for base structure 232 to have a reduced thickness (e.g., extend as little as possible into center opening 233).

Base structure 232 can include walls 234 defining an outer periphery for inner accessory 230. Walls 234 can extend around a boundary of base structure 232 to form a continuous or partially continuous outermost surface or series of surfaces. In some cases, walls 234 can be disposed and sized such that base structure 232 may be received within walls 224 of outer accessory 220, which may also form a loop having substantially the same shape as inner accessory 230. In particular, walls 234 may be sized and positioned such that an external surface of walls 234 is substantially placed in contact with or adjacent to an internal surface of walls 224 of outer accessory 220. The height of walls 234 can then, in some cases, be at most equal to the height of walls 224, and preferably less than the height of walls 224 such that the entirety of inner accessory 230 can fit within outer accessory 220.

Inner accessory 230 can be secured to outer accessory 220 using any suitable approach. In some cases, one or both of outer accessory 220 and inner accessory 230 can include interconnecting or interlocking features. For example, one or both of wall 224 and base structure 232 can include a protrusion, hook, detect, plug, indentation, bump, hole, or other feature for improving the coupling of the components. In some cases, each of inner accessory 230 and outer accessory 220 can include one or more complimentary features for engaging inner accessory 230 within outer accessory 220. The features can be provided on any surface of either component, though in some cases it may be beneficial to provide the features on the surfaces of walls 224 and 234 that are placed adjacent to each other and that may interface (e.g., use complimentary features).

Alternatively, one or more securing mechanisms can be used to couple inner accessory 230 to outer accessory 220. For example, a clip, a fastener, an adhesive, tape, a spring, hook and fastener material, or other such mechanisms could be used. In some cases, the mechanisms can be provided such that the mechanism engages one of top surface 238 or bottom surface 236 of inner accessory 230. For example, a screw can pass through a portion (e.g., a plate or protruding shelf) of outer accessory 220 and into a tapped screw hole on bottom surface 236. As another example, a clip can be disposed such that it is secured to outer accessory 220 and extends over top surface 238. In other cases, inner accessory 230 can be press fit into outer accessory 220.

In some cases, inner accessory 230 can be retained in luminaire 200 by base 210 and outer accessory 220. In particular, outer accessory 220 can be constructed such that it includes at least one tab or surface that is placed in contact with bottom surface 236. Similarly, base 210 can be constructed such that it includes at least one tab or surface that is placed in contact with top surface 238. Then, when outer accessory 220 is placed over base 210, the respective tabs or surfaces of each of base 210 and outer accessory 220 can constrain inner accessory 230 within luminaire 200. The mechanism used to secure outer accessory 220 to base 210 can indirectly secure inner accessory 230 within outer accessory 220 and in luminaire 200.

Base structure 232 can include any suitable feature to retain optical component 250 within luminaire 200. In some cases, base structure 232 can include platform 240 recessed relative to top surface 238. Internal platform 240 can have any suitable depth relative to top surface 238. For example, the depth of internal platform 240 can be substantially equal to or larger than a thickness of optical component 250. In this manner, outer surface 252 of optical component 250, described in more detail below, can be in the same plane as top surface 238, or recessed relative to top surface 238. In addition, this may maintain optical component 250 in a different plane than bottom surface 236, which can correspond to the surface of a ceiling or grid used to mount luminaire 200.

Internal platform 240 can have any suitable width, and thus any suitable surface for supporting optical component 250. In some cases, the surface of internal platform 240 can vary in different regions of base structure 232. For example, internal platform 240 can include larger surfaces 241 in regions near corners of base structure 232 (e.g., when base structure 232 is a square), and smaller surfaces 242 in regions between corners of base structure 232. (e.g., along a side of the square) In this manner, more support can be provided to portions of optical component 250 that are further from the center of opening 233 and the center of outer accessory 220. This approach may further improve the distribution of light by luminaire 200.

Although the example of FIGS. 2-9 shows internal platform 240 as a continuous surface, it will be understood that base structure 232 can instead include several distinct tabs or protrusions extending from side walls 234 and recessed relative to top surface 238. The position and dimensions of each element forming internal platform 240 can be selected, for example, based on dimensions of optical component 240, the weight, stiffness, or other mechanical property of optical component 240, a desired radiation pattern to provide, the position of light sources within luminaire 200, or combinations of these.

Optical component 250 can be secured to internal accessory 230 using any suitable approach. In some cases, a bottom surface 254 of optical component 250 can be secured to internal platform 240. For example, an adhesive or tape can be applied to portions of bottom surface 254 that come into contact with internal platform 240 when optical component 250 is placed within inner accessory 230. The adhesive or tape can then secure optical component 250 without affecting optical properties of the portions of optical component 250 that extend over opening 233, and thus transmit light from a light source. In some cases, other securing mechanisms such as, for example, hook and loop material, fasteners, clips, springs, a press fit, or a magnet can be used.

In some cases, optical component 250 can be releasably coupled to luminaire 200. For example, optical component 250 and inner accessory 230 can be retained together between base 210 and outer accessory 220 when the outer accessory is secured to the base. In particular, a surface of outer accessory 220 can be placed in contact with bottom surface 236 of inner accessory 230, and a surface of base 210 can be placed in contact with top surface 238 of inner accessory 230, optical component 250, or both, when the base and cover are secured together. The inner accessory and the optical component can then be trapped within luminaire 200, but easily removed by decoupling base 210 from outer accessory 220. In some cases, the functionality of outer accessory 220 can be integrated in base 210, such that a distinct or separable outer accessory 220 may not be necessary.

Optical component 250 can include any suitable optical property. For example, optical component 250 can include a diffuser, a light guide, a UV filter, a polarization component, a prism, a lens, an infrared coating, an anti-reflective coating, a dichroic coating, a dielectric coating, or any other component or coating that adjusts optical properties of light passing through optical component 250. Any suitable approach can be used to provide these features to optical component 250 including, for example, incorporating elements in the material of optical component 250, applying a coating, processing a surface (e.g., polishing or roughening), or combinations of these.

The particular property or properties of optical component 250, as well as the orientation or tuning of the properties can be customized for particular purposes. In some cases, optical component 250 can be customized for a particular environment in which luminaire 200 is to be placed. Alternatively, optical component 250 can be customized based on the light source used for luminaire 200. For example, optical component 250 can be constructed to provide a substantially Lambertian reflectance out of luminaire 200 when the light source includes a LED module, which typically provides collimated light.

Optical component 250 can be constructed from any suitable material. In some cases, an acrylic, polycarbonate, glass, or another plastic material that is substantially transparent can be used. Based on the material selected, different manufacturing processes can be used to provide desirable optical properties. For example, optical component 250 can be molded (e.g., injection molded, compression molded, or vacuum formed), extruded, machined, cast, or thermoformed with desired features, or features can be defined after optical component 250 has been formed. In some cases, one or more surfaces of the optical component can be processed to modify improve its properties. For example, the surfaces of the optical component can be polished (e.g., using an abrasive tool).

Once optical component 250 has been placed in inner accessory 230, inner accessory 230 can be placed in outer accessory 220 and base 210 secured to outer accessory 220 to complete assembly of the luminaire. In contrast with the cover described in connection with luminaire 100 (FIG. 1), however, outer accessory 220 may not include optical features for adjusting light transmitted by luminaire 200. Instead, outer accessory 220 may provide support for securing inner accessory 230 and optical component 250. Furthermore, optical component 250 may be offset from a bottom surface of outer accessory 220 (and offset from a bottom surface of luminaire 200, or from a surface of luminaire 200 that is exposed or visible when the luminaire is mounted) by outer accessory 220 and inner accessory 230 to reduce glare caused by optical component 250.

By disassociating the features modifying optical attributes of the luminaire from the cosmetic exterior, the cost of producing high quality luminaires can be substantially decreased. For each product line constructed (e.g., each type or size of luminaire), the base, inner component, and outer component can all be standard parts and easily produced in large quantities at lower costs. For applications where light need not be customized, such as larger environments, (e.g., large conference centers) or lower profile environments (e.g., a parking garage), the luminaire can include a standard or default optical component (e.g., a basic diffuser). For applications where a higher light quality is desired, or where the environment requires a specific light distribution, a customized optical component can be constructed and incorporated within the luminaire. This modular approach can allow a manufacturer to charge a premium for the highest quality fixtures while limiting the actual cost for constructing such a fixture.

Figure 10:
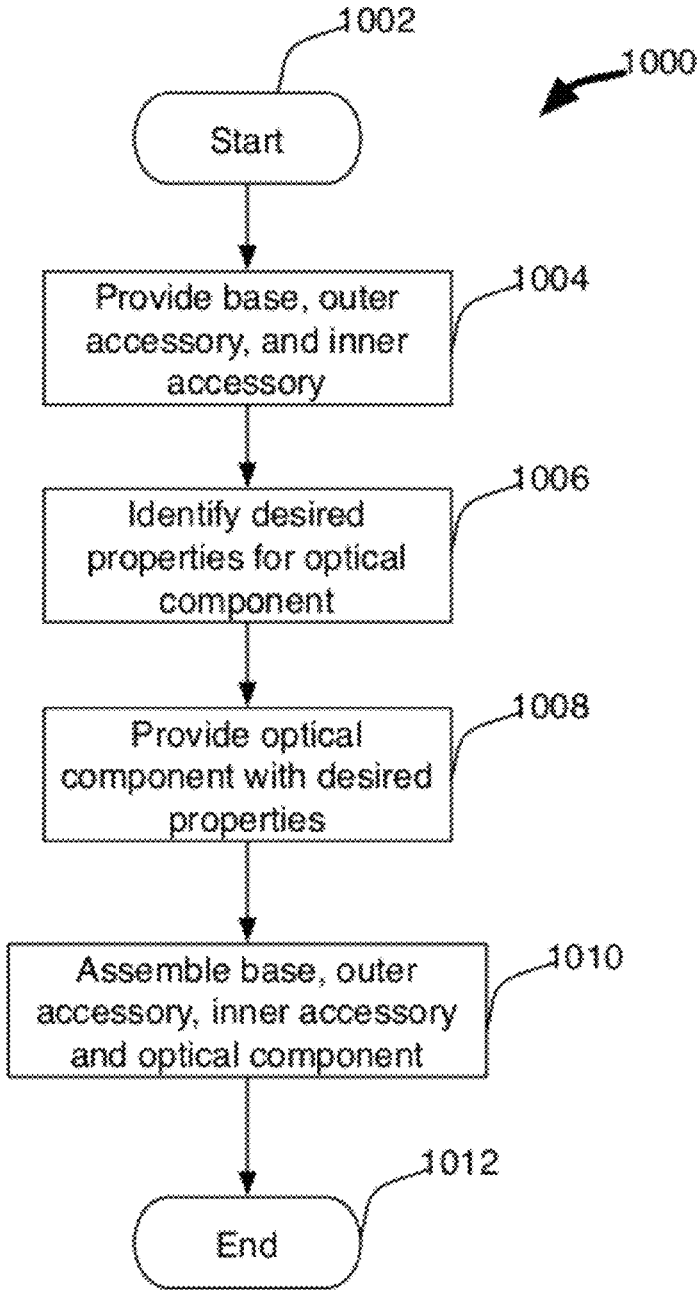
FIG. 10 is a flow chart of an illustrative process for constructing a luminaire having a separable optical component in accordance with some embodiments of the invention.

FIG. 10 is a flow chart of an illustrative process for constructing a luminaire having a separable optical component in accordance with some embodiments of the invention. Process 1000 can begin at step 1002. At step 1004, a base, an outer accessory and an inner accessory can be provided. For example, standard components corresponding to a line of products can be provided. At step 1006, desired properties for an optical component can be identified. For example, optical properties of corresponding to factors such as, for example, an environment in which the luminaire is placed, a desired light pattern, a type of light source, and other factors can be identified. At step 1008, an optical component with the desired properties can be provided. For example, an optical component can be constructed such that it redirects light as desired for the environment in which the luminaire is to be placed. At step 1010, the base, outer accessory, inner accessory and optical component can be assembled to form the luminaire. In some cases, the optical component can first be secured to the inner accessory. The inner accessory and optical component can be removed and replaced in the luminaire to configure the luminaire for different lighting schemes. Process 1000 can end at step 1012.

It is to be understood that the steps shown in process 1000 of FIG. 10 are merely illustrative and that existing steps may be modified or omitted, additional steps may be added, and the order of certain steps may be altered. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The above-described embodiments of the invention are presented for purposes of illustration and not of limitation.

What is claimed is:

1. A modular luminaire comprising:
- a base;
- a light source placed within the base;
- an optical component operative to modify a pattern of light transmitted by the optical component from the light source;
- an inner accessory operative to receive the optical component in a recessed position relative to a bottom surface of the inner accessory; and
- an outer accessory operative to releasably receive the inner accessory, wherein the outer accessory is secured to the base.

2. The modular luminaire of claim 1, wherein the optical component is substantially planar.

3. The modular luminaire of claim 1, wherein the optical component comprises a diffusive layer.

4. The modular luminaire of claim 1, wherein the inner accessory defines a loop.

5. The modular luminaire of claim 1, wherein the inner accessory further comprises:
- a side wall defining an exterior periphery of the inner accessory; and
- a recessed platform within the loop, the recessed platform is operative to support the optical component.

6. The modular luminaire of claim 1, wherein the depth of the recessed platform relative to a top surface of the inner component is substantially equal to a thickness of the optical component.

7. The modular luminaire of claim 1, wherein the outer accessory defines a loop, the inner accessory is operative to be placed within the loop of the outer accessory.

8. The modular luminaire of claim 1, wherein an inner surface of the outer accessory and an outer surface of the inner accessory include complimentary features for securing the inner accessory within the outer accessory.

9. The modular luminaire of claim 1, wherein the light source comprises at least one of:
- an incandescent light source;
- a fluorescent light source; and
- a solid state lighting source.

10. A method for constructing a modular luminaire comprising:
- providing a base;
- providing a light source retained in the base;
- providing an outer accessory operative to be coupled to the base;
- providing an inner accessory operative to be received within the outer accessory;
- providing an optical component operative to be retained within the inner accessory, the optical component is offset from a bottom surface of the inner accessory; and
- assembling the optical component to the inner accessory, the inner assembly to the outer accessory, the light source to the base, and the outer accessory to the base to construct the modular luminaire.

11. The method of claim 10, further comprising:
- determining a desired radiation pattern for the modular luminaire based on the environment in which the luminaire is placed; and
- defining an optical component with optical properties corresponding to the desired radiation pattern.

12. The method of claim 10, wherein determining the desired radiation pattern further comprises determining a desired luminance for different regions of the environment.

13. The method of claim 10, further comprising releasably securing the inner accessory to the outer accessory to provide access to the light source.

14. The method of claim 10, wherein the inner accessory is releasably secured using at least one of:
- an adhesive;
- tape;
- a fastener;
- a clip;
- a spring; and
- a complimentary feature.

15. An inner accessory for use with a drop grid ceiling luminaire, comprising:
- a base structure defining a loop having a center opening;
- an outer wall extending around a periphery of the base structure, wherein the outer wall is operative to releasably engage a portion of the drop grid ceiling luminaire; and
- a recessed platform offset from a bottom surface of the base structure, the recessed platform comprises:
  - at least a first region having a larger thickness measured from the outer wall towards a center of the base structure; and
  - at least a second region having a smaller thickness measured from the outer wall towards a center of the base structure.

16. The inner accessory of claim 15, further comprising at least one feature for engaging the portion of the drop grid luminaire.

17. The inner accessory of claim 15, wherein the outer wall extends continuously around the periphery of the base structure.

18. The inner accessory of claim 15, wherein the base structure substantially defines a square; the at least a first region corresponds to a region adjacent to a corner of the square; and the at least a second region corresponds to a region adjacent to an edge of the square.

19. The inner accessory of claim 15, wherein the optical component is releasably coupled to the base structure.

* * * * *